United States Patent [19]

Theurer

[11] Patent Number: 4,878,435

[45] Date of Patent: Nov. 7, 1989

[54] MOBILE TIE EXCHANGE MACHINE ARRANGEMENT

[75] Inventor: Josef Theurer, Vienna, Austria

[73] Assignee: Franz Plasser Bahnbaumaschinen-Industriegesellschaft m.b.H., Vienna, Austria

[21] Appl. No.: 307,825

[22] Filed: Feb. 7, 1989

[30] Foreign Application Priority Data

Jun. 28, 1988 [EP] European Pat. Off. ..... 88890168-3

[51] Int. Cl.[4] ..... E01B 27/11; E01B 27/13

[52] U.S. Cl. ..... 104/9; 104/2; 104/7.1; 104/137

[58] Field of Search ..... 104/2, 9, 6, 7.1, 7.2, 104/7.3, 137

[56] References Cited

U.S. PATENT DOCUMENTS

| | | | |
|---|---|---|---|
| 4,018,165 | 4/1977 | Bryan, Jr. | 104/9 |
| 4,047,280 | 9/1977 | Dieringer | 104/9 |
| 4,253,398 | 3/1981 | Theurer et al. | 104/2 |
| 4,418,625 | 12/1983 | Allmer | 104/9 |
| 4,579,060 | 4/1986 | Nameny et al. | 104/9 |
| 4,611,541 | 9/1986 | Theurer | 104/9 |
| 4,770,103 | 9/1988 | Allmer | 104/7.1 |

FOREIGN PATENT DOCUMENTS 2230202 8/1973 Fed. Rep. of Germany .

OTHER PUBLICATIONS

Railway Track Structures, Nov. 83, pp. 22–24.

*Primary Examiner*—Douglas C. Butler
*Assistant Examiner*—Matthew C. Graham
*Attorney, Agent, or Firm*—Kurt Kelman

[57] ABSTRACT

A mobile machine arrangement for exchanging old track ties for new track ties comprises first and second machine units, a drive for propelling each machine unit independently along the track in an operating direction, an operator's cab for each machine unit, each machine unit comprising a bridge-like machine frame, a tie loading car coupled to the machine frame and undercarriages supporting the machine frame and the tie loading car on the track, a respective tie exchange device for laterally pulling old ties out of the track mounted on the machine frame of the leading machine unit and for laterally inserting new ties into the track mounted on the machine frame of the trailing machine unit, each tie exchange device comprising power-driven vertically and longitudinally adjustable tie gripping devices, a control for the tie exchange device mounted on each machine unit, and a tie transport arrangement mounted on the machine frame and tie loading car of each machine unit.

10 Claims, 1 Drawing Sheet

MOBILE TIE EXCHANGE MACHINE ARRANGEMENT

BACKGROUND OF THE INVENTION

1. Field of the Invention

The present invention relates to a mobile machine arrangement for exchanging individual or groups of old ties for individual or groups of new ties in a track consisting of two rails fastened to ties and supporting respective machine frames for mobility in an operating direction, each machine frame being supported on the track by undercarriages, being propelled along the track and carrying a tie exchange device comprising power-driven vertically and longitudinally adjustable tie gripping means, the tie exchange device on a leading machine frame, in the operating direction, being arranged for laterally pulling old ties out of the track and the tie exchange device on a trailing machine frame being arranged for laterally inserting new ties into the track.

2. Description of the Prior Art

U.S. Pat. No. 4,253,398, dated Mar. 3, 1981, discloses a mobile apparatus for the continuous replacement of ties with which all the ties of a track are sequentially exchanged as the apparatus advances continuously while the rails are raised and spread apart above a section where the ties are exchanged. This apparatus has been successfully used for the complete exchange of all ties.

U.S. Pat. No. 4,511,541, dated Sept. 16, 1986, discloses a continuously advancing ballast cleaning machine which comprises the tie pullers and inserters operated while the track is lifted and the ballast is excavated, cleaned and returned to the track bed. The two tie exchange devices are mounted on the machine frame between two swivel trucks supporting the machine frame ends and are longitudinally displaceable in the direction of elongation of the machine frame. The tie exchange devices are utilized only along a section of the track ahead of, at and behind obstacles extending along a shoulder of the track while the machine continuously advances. In other words, these tie exchange devices are only auxiliary means on the ballast cleaning machine to enable the ballast excavating chain to operated properly when lateral obstacles are encountered along the track and while the track is lifted to enable the ballast to be excavated. There is no indication in the patent how and from where to control the operation of the tie exchange devices since no operator's cab for these devices is discernible.

It is also known and widely practiced, particularly in Australia and the United States of America, to exchange only individual ties or groups of adjacent ties in an existing track while retaining the old ties between the exchanged ties. Such partial tie exchanges are repeated every few years so that eventually all the old ties are replaced by new ties in the track. A mechanized tie gang for such a partial tie exchange has been disclosed on pages 22 to 24 of "Railway Track & Structures", November 1983. It comprises 24 pieces of equipment spaced from each other along the track and operating independently of each other to execute not only the tie exchange but also additional work, such as tie transport, tie cutting, ballast regulating and the like. The pulled and optionally cut ties are placed on the shoulder along the track and then moved onto a tie loading car. Similarly, the new ties are deposited from tie loading cars on the track shoulder and then inserted in the track. The ties may be transported, loaded and/or unloaded at times other than the time of the tie exchange.

A great variety of the tie exchange devices are known, which have a crane- or boom-like frame equipped with a tie gripping tong which may be operated by a clamping drive. U.S. Pat. No. 4,579,060, dated Apr. 1, 1986, for example, discloses such a tie exchange device cantilevered to a front end of a work car and comprising a power-operated pivotal crane carrying a tie gripping head actuated by a hydraulic cylinder-piston drive. The large dimension of the crane in comparison to the relatively small work car makes this machine rather labile and the structure is rather complex. In addition, the lateral pulling of an old tie out of the track and the lateral insertion of a new tie into the track is difficult because the weight of the car is transmitted to the track by an undercarriage immediately adjacent the tie being replaced. Also, the compound clamping head is designed for simultaneously gripping a new tie and an old tie to enable the clamping head to pull an old tie and insert the new tie in two subsequent operations. This makes the tie exchange operation quite difficult for the operator and, in addition, the unbalanced weight of the crane at one side of the car interferes with an accurate, rapid and trouble-free tie exchange operation. The apparatus can be used only for the spot exchange of individual ties, the old ties being usually placed on the track shoulder whence the new ties are then picked up by the clamping head for insertion. This equipment has quite a limited tie exchange capacity. Such small cars usually are not self-propelled and they can be moved along the track only at low speed.

Another type of a bidirectionally operative tie exchanging apparatus has been disclosed in U.S. Pat. No. 4,418,625, dated Dec. 6, 1983. This apparatus comprises a railroad car supported by undercarriages for mobility on the track. A telescopingly retractible tie gripping device is mounted between the undercarriages at each lateral side of the car frame. The vertically and transversely adjustable device has a clamping drive. Individual ties may be laterally pulled out of, or inserted into, the track at each said of the car. The apparatus provides no monitoring or control possibility for the two tie gripping devices, no operator's station being arranged within view of the devices. Presumably, they are actuated by an operator standing on a respective track shoulder. The capacity and accuracy of this apparatus is also rather limited because of the inadequacy of the control and the intermittent advance of the machine from tie to tie. Since the space between the track and the frame of the railroad car is quite small, the construction of the tie exchange apparatus must be very compact. A mobile installation must precede and follow the tie exchange car to transport the old ties placed on the shoulder and to transport the new ties for placement on the shoulder, which may be done simultaneously with the tie exchange or at a later time.

German patent application No. 2,230,202, published Aug. 16, 1973, discloses a machine for removing ballast from a track bed, which comprises a machine frame and power-driven vertically and transversely adjustable ballast scarifier tools mounted on a forwardly projecting end of the machine frame. A power-driven longitudinally displaceable push rod precedes the plate-like ballast scarifier tools for engagement with a respective tie for displacing the tie in the direction of the track whereby ballast may be moved to a respective shoulder under the displaced tie over the ballast scarifier tool.

SUMMARY OF THE INVENTION

It is the primary object of this invention to improve a mobile tie exchange machine arrangement of the first-described kind, especially for the partial replacement of the ties of an existing track, so that the pulling of the old ties laterally out of the track and the insertion of the new ties laterally into the track may be effectuated in a simpler and more dependent manner with a considerably enhanced operating efficiency.

The above and other objects are accomplished according to the invention with a mobile machine arrangement for exchanging old ties for new ties in a track consisting of two rails fastened to ties and supporting the machine arrangement for mobility in an operating direction, which comprises a first machine unit leading in the operating direction, a second machine unit trailing in the operating direction, a drive for propelling each machine unit independently along the track in the operating direction, and an operator's cab for each machine unit, each machine unit comprising a bridge-like machine frame, a tie loading car coupled to the machine frame and undercarriages supporting the machine frame and the tie loading car on the track. A tie exchange device for laterally pulling a respective one of the old ties out of the track is mounted on the machine frame of the first machine unit and a tie exchange device for laterally inserting a respective one of the new ties into the track is mounted on the machine frame of the second machine unit, each tie exchange device comprising power-driven vertically and longitudinally adjustable tie gripping means. A control for the tie exchange device is mounted on each machine unit, and a tie transport arrangement is mounted on the machine frame and tie loading car of each machine unit.

This simple yet advantageous arrangement of a respective tie exchange device within view of an operator with its own control and on an independently propelled machine unit makes an individualized and rational use of the machine arrangement possible even if the number of the sequentially replaced ties varies greatly. These simply constructed machine units result in a very great operating capacity while the tie exchange proceeds lie in a moving assembly line. Since each machine unit has its own propelling drive, operator's cab and control, their use is largely independent from each other so that any disadvantageous influence on the operating capacity of one machine unit by the other unit operating at lower capacity can be avoided, for example, when the mobile machine arrangement runs along a track section where the distances between the ties to be exchanged are greater. Since the pulled old ties as well as the new ties to be inserted are continuously and independently transported from and to the respective tie exchange devices above, and in the direction of, the track, there is no need for the temporary placing of the ties on the track shoulder, which sometimes is difficult because of space limitations and also wastes time and work, thus increasing the operating capacity.

BRIEF DESCRIPTION OF THE DRAWING

The above and other objects, advantages and features of the present invention will become more apparent from the following detailed description of a now preferred embodiment thereof, taken in conjunction with the somewhat diagrammatic accompanying drawing wherein.

DETAILED DESCRIPTION OF PREFERRED EMBODIMENT

Figures 1, 2, 3, 4:
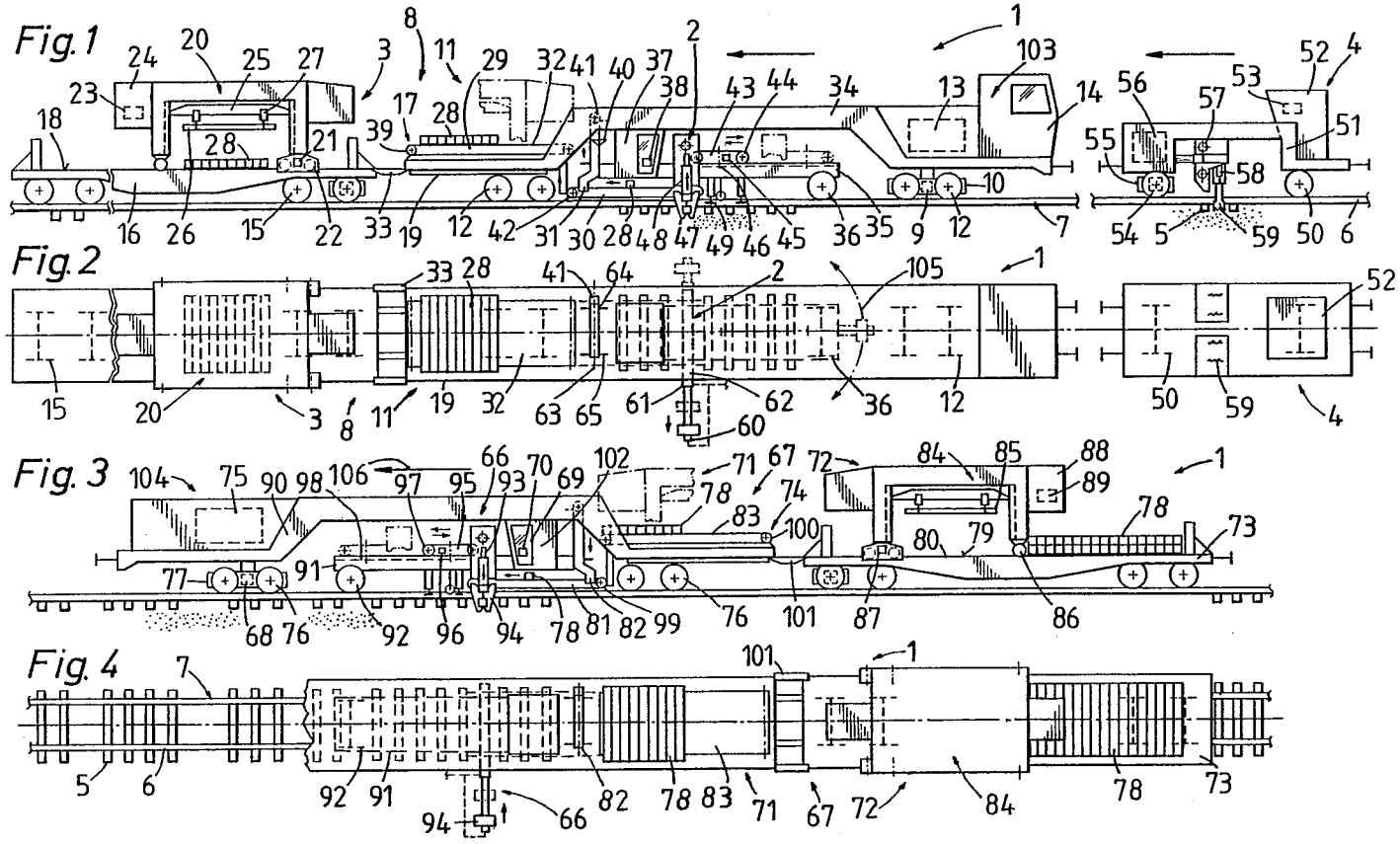
FIG. 1 is a side elevational view of the leading machine unit of the machine arrangement, followed by a ballast scarifier.
FIG. 2 is a top view of FIG. 1.
FIG. 3 is a side elevational view of the trailing machine unit of the machine arrangement.
FIG. 4 is a top view of FIG. 3

Referring now to the drawing, mobile machine arrangement 1 for exchanging old ties 5 for new ties 78 in track 7 consisting of two rails 6 fastened to ties and supporting the machine arrangement for mobility in an operating direction indicated by horizontal arrows comprises first machine unit 8 leading in the operating direction and second machine unit 67 trailing in the operating direction. Drive 9, 68 propels each machine unit 8, 67 independently along track 7 in the operating direction, cooperating with brake 10, 77. Each machine unit 8, 67 has its own operator's cab 37, 69 and comprises bridge-like machine frame 11, 71, tie loading car 3, 72 and undercarriages 12, 15, 76 supporting the machine frame and tie loading car on track 7. Tie exchange device 2 for laterally pulling a respective one of old ties 5 out of track 7 is mounted on machine frame 11 of first machine unit 8, and tie exchange device 66 for laterally inserting a respective one of new ties 78 into the track is mounted on machine frame 71 of second machine unit 67, the two machine units constituting tie exchange machines 103, 104. Each tie exchange device 2, 66 comprises power-driven vertically and longitudinally adjustable tie gripping means 47, 94. Respective control 38, 70 for each tie exchange device is mounted on each machine unit and respective tie transport arrangement 17, 74 is mounted on the machine frame and tie loading car of each machine unit 8, 67.

In the illustrated preferred embodiment, machine units 8 and 67 are mirror-symmetrically arranged on track 7, tie loading car 3 of first machine unit 8 forming the beginning of machine arrangement 1, and tie loading car 72 of second machine unit 67 forming the end of the machine arrangement. Such a construction is particularly simple and very easy to operate, making it most economical. By placing the tie loading cars at the beginning and the end of the machine arrangement, these loaded cars will not subject those short track gaps where the ties are exchanged to their heavy loads. In view of the mirror-symmetrical arrangement of the two tie exchange machines 103, 104, the equivalent components of both machines will be described simultaneously, with the respective numerals designating the equivalent parts. This will considerably simply the description.

The illustrated machine arrangement further comprises self-propelled ballast removal machine 4 centered on track 7 between the first and second machine units. The ballast removal machine comprises machine frame 51 supported by undercarriages 50 on track 7, independent drive 54 for propelling the machine frame along the track and vertically and transversely adjustable ballast scarifying means 59 for removing ballast from respective cribs defined between adjacent ties 5. Operator's cab 52 housing control console 53 is mounted on machine frame 51 which also holds power plant 56 supplying power to drives 57 and 58 for transversely and vertically displacing the ballast scarifier tools which are mounted in an upwardly recessed portion of the machine frame between the undercarriages. This independently operable ballast scarifier makes it possible to remove the ballast from the gaps in the track created by the removal of the old ties independently of the continuous forward movement of the two tie exchange machine units, which increases the operating efficiency of the succeeding tie inserter.

One end of machine frame 11, 71 carries central power plant 13, 75 for machine unit 8, 67. Driver's cab 14 is mounted at this rear end of machine frame 11 while machine frame 16, 73 of tie loading car 3, 72 is coupled to the opposite machine frame end. Each tie transport arrangement 17, 74 comprises a respective tie loading platform 18, 79 extending in a plane, and auxiliary rails 19, 80 are coplanar with the tie loading platforms. As shown, each tie transport arrangement comprises a first section 29 mounted on machine frame 11, 71, respectively, essentially comprising first tie conveyor band 30, 81 immediately adjacent tie exchange device 2, 66, vertical tie conveyor 31, 82 adjacent the first tie conveyor band and second tie conveyor band 32, 83 adjacent the vertical tie conveyor. A respective second section of the tie transport arrangement is mounted on tie loading car 3, 72, respectively, and essentially comprises gantry crane 20, 84 mounted on the auxiliary rails for mobility in the direction of track 7. Each gantry crane is equipped with vertically adjustable tie hoisting means 25, 85 and is propelled by its own drive 21, 87, respective undercarriages 22, 86 supporting each gantry crane on the auxiliary rails. The undercarriages of the gantry cranes have double-flanged wheels running on the auxiliary rails. Each gantry crane has a respective operator's cab 24, 88 housing control console 23, 89 for operating the tie hoisting means. The tie hoisting means comprises two parallel tie gripper rails 26 extending in the operating direction and movable by drives 27 into clamping engagement with the ends of old ties 18 and new ties 78, respectively resting on loading platform 18 and 80. Auxiliary rails 19, 80 are connected respectively with tie loading car 3, 72 and with a portion of machine frame 11, 71 adjacent second tie conveyor band 32, 83 and comprise longitudinally displaceable connecting rail sections 33, 101 bridging a gap between the tie loading car and the machine frame portion coupled thereto. Such auxiliary rails provide for a very efficient tie transport and enable a gantry crane to be moved therealong above the loading platform of the tie loading car to pick up the old ties and deposit the new ties, respectively, for transport. The two tie conveyor bands at different levels cooperate with the vertical tie conveyor therebetween so that the ties may be readily moved between the lower tie conveyor band associated with the tie exchange device and the upper tie conveyor band associated with the loading platform. Since the auxiliary rails extend over the tie loading car as well as the front machine frame portion and the gap therebetween is bridged by longitudinally displaceable rail sections to provide continuously extending auxiliary rails, the gantry crane can move unhindered between the loading platform and the second tie conveyor band to enable the crane to transport a multiplicity of ties piled in packed stacks on the hoisting means.

As illustrated in FIGS. 1 and 3, each machine frame 11, 71 is an elongated, bridge-like carrier frame 34, 90 defining an upwardly recessed center portion extending between respective undercarriages 12 and 76 and carrying vertical tie conveyor 31, 82 and second tie conveyor band 32, 83. Respective carriage 35, 91 is mounted in the upwardly recessed center portion below each carrier frame and respective tie exchange device 2, 66, and first tie conveyor band 30, 81 is mounted on each carriage. Such a carrier frame provides sufficient space for housing the tie exchange device and can absorb sufficient stress and pressure forces to enable it to be incorporated into a train for movement between operating sites. In the illustrated embodiment, the carriage is linked to the carrier frame at one end thereof adjacent the vertical tie conveyor and is supported on track 7 by respective undercarriage 36, 92 at an end opposite to the one carriage end. The one end of the carriage may be on a projecting pole, and this type of carriage has the advantage of automatically centering the carriage on the track in curves so that the tie exchange devices will always be properly aligned with the tie to be pulled or inserted. Furthermore, since the carriage is supported on the track, the undercarriages supporting the bridge-like machine frame will be relieved of the weight of the carriage.

Operator's cab 37, 102 of each machine unit 8, 67 is mounted on respective carriage 35, 91 above the first tie conveyor band, and control console 38, 70 is arranged in each operator's cab. This arrangement gives the operator a substantially unobstructed view of the tie exchange device and the adjacent tie conveyor band, thus facilitating the operation of the control.

Each second tie conveyor band 32, 83 of respective tie transport arrangement 17, 74 has its own drive 39, 100, each first tie conveyor band 30, 81 is driven by drive 42, 99 and each vertical tie conveyor 31, 82 is constituted by revolving chain 64 trained about axis 63 and driven by driven 41. Each chain is equipped with horizontally projecting tie holders 65 on which the respective ties rest while they are conveyed between the lower an d higher tie conveyor band, all drives being actuated from control console 38, 70, respectively. A plurality of ties 28, 78 are collected on tie conveyor bands 32, 83 for conveyance between the respective tie loading car and vertical tie conveyor. Tie conveyor 31, 82 has a device 40 for pushing each tie off vertical conveyor 31 onto second tie conveyor band 32 (and from second tie conveyor band 83 onto vertical conveyor 82). Ties 28, 78 are received sequentially from tie exchange device 2 (and from tie loading car 72) in the same orientation as in the track, i.e. extending transversely thereto, and are transported in this orientation between the tie loading car and the tie exchange device. Each tie exchange device is connected to a carrier 43, 95 supported by flanged by wheels 44, 97 on guide rails 98 mounted on carrier frame 35, 91 and longitudinally displaceable along the guide rails by drive 45, 96. The longitudinal displaceability of the tie exchange devices enables the machine to operate at maximum efficiency and at a uniform operating rythm because the machine arrangement may advance continuously along track 7 while the tie exchange proceeds according to local conditions. The continuous movement of the machine units also is very energy-effective since it saves intermittent braking and starting of the heavy machine frames. Each tie exchange device may be pivoted about a vertical axis 46 on carrier 53, 95 so that tie gripping means 47, 94 may be put into operation at either side of the track, or may be be positioned centrally along the axis of the machine when the machine arrangement is moved between operating sites (chain-dotted lines in FIG. 2). The tie gripping means comprises tongs designed to clamp respective tie ends therebetween and is vertically adjustable into a clamping position by drive 48, 93. Carriage 35 has laterally pivotal retaining rollers 49 which may be pressed against rails 6 for securely holding the carriage on track 7.

As can be seen in FIG. 2, tie gripping means 47, 94 comprises a pair of cooperating clamping elements which may be opened and closed by drive 60 and which are mounted on telescoping support 61 for transverse adjustment by drive 62.

The operation of machine arrangement 1 will now be described in detail.

Drives 9, 54 and 68 are actuated to move machine units 8, 67 and ballast removal machine 4 independently along track 7 to the operating site, tie loading car 72 carrying the required amount of new ties 78. As soon as the operating site requiring the exchange of old ties 28 has been reached by leading machine unit 8, drive 45 is actuated to move tie exchange device 2 into its foremost operating position shown in full lines in FIG. 1. Drives 60, 48, 62 are now actuated to operate tie gripping means 47 by lowering the tongs for engagement with the end of an old tie 28, clamping the tie end and laterally pulling it out of the track in two or three successive stages, if needed, by engaging the tie at staggered points between each pulling stage. During this lateral withdrawal of the old tie, drives 9, 54 and 68 are actuated to move the two machine units and the ballast removal machine independently of each other and continuously in the operating direction indicated by the horizontal arrows, which causes tie exchange device 2 to be rearwardly displaced into the position shown in chain-dotted lines in FIG. 1, at which point old tie 28 has been fully pulled out of track 7. Thereupon, drive 45 is actuated to displace the tie exchange device back into its forward position, in which the withdrawn tie is placed on tie conveyor band 30. The tie exchange device is now in position for gripping and pulling the next old tie 28 to be withdrawn in the above-described manner. Meanwhile, drive 42 is actuated to drive tie conveyor band 30 and convey the tie placed thereon to vertical tie conveyor 42 which elevates the tie to device 40 which pushes it onto tie conveyor band 32.

As soon as a row of adjacent ties 28 has been collected on tie conveyor band 32, grantry crane 20 is moved on auxiliary rails 19 into a position wherein its hoisting means 25 are in vertical alignment with the row of ties, whereupon the hoisting means is lowered and pivotal gripping rails 26 are pressed against the the ends of the ties so that the row of ties is securely held therebetween. The tie hoisting means is now raised and drive 21 is actuated to move the gantry crane to tie loading car 3 into vertical alignment with loading platform 18 wherein the grip of rails 26 on the tie ends is released to place old ties 28 on the loading platform. The transport of old ties 28 pulled out of track 7 is effected unhindered by tie transport arrangement 17 while machine unit 8 continuously advances along track 7 and the operation is controlled from control console 38 by an operator in cab 37.

Depending on the condition of the ties and the desired tie exchange method, groups of two old ties 28 may, for instance, be pulled out while groups of three or more ties 5 are retained therebetween in track 7. As indicated hereinabove, tie gripping means 47 may be pivoted about vertical axis 46 so that it may operate at a selected shoulder of the track for pulling ties from opposite ends.

While leading machine unit 8 advances continuously along the track, ballast removal machine 4 independently follows the leading machine unit to scarify the ballast in the gaps left bay the withdrawn ties, plate-shaped ballast scarifier tools 59 being vertically and transversely displaced by drives 57, 58 to scarify and plane the ballast. New ties 78 are then inserted there laterally by trailing machine unit 67 which also advances independently and continuously along track 7 in an operating direction indicated by arrow 106. In this operation, gantry crane 84 transports rows of new ties 78 to tie conveyor band 83 which conveys the new ties to vertical tie conveyor 82 which receives each leading new ties 78 sequentially from the tie conveyor band and lowers it to lower tie conveyor band 81 which moves the new tie into the grasp of tie gripping means 94 of tie exchange device 66. Drive 96 is then actuated to move the tie exchange device into its forward end position shown in chain-dotted lines in FIG. 3 where the new tie is laterally inserted into track 7 in the same manner, but in reverse, as hereinabove described in connection with the withdrawal of the old ties. During the continuous advance of the machine unit and carriage 91, tie exchange device 66 and its carrier 95 will be displaced along guide rails 98 into the rear end position shown in full lines in FIG. 3. After this rear end position has been reached, the insertion of the new tie into the track is completed. The operator in cab 102 now initiates the next tie insertion of a subsequent new tie 78.

What is claimed is:

1. A mobile machine arrangement for exchanging old ties for new ties in a track consisting of two rails fastened to ties and supporting the machine arrangement for mobility in an operating direction, which comprises (a) a first machine unit leading in the operating direction, (b) a second machine unit trailing in the operating direction, (c) a drive for propelling each machine unit independently along the track in the operating direction, (d) an operator's cab for each machine unit, each machine unit comprising (1) a bridge-like machine frame, (2) a tie loading car coupled to the machine frame and (3) undercarriages supporting the machine frame and the tie loading car on the track, (e) a tie exchange device for laterally pulling a respective one of the old ties out of the track mounted on the machine frame of the first machine unit, (f) a tie exchange device for laterally inserting a respective one of the new ties into the track mounted on the machine frame of the second machine unit, each tie exchange device comprising (1) power-driven vertically and longitudinally adjustable tie gripping means, (g) a control for the tie exchange device mounted on each machine unit, and (h) a tie transport arrangement mounted on the machine frame and tie loading car of each machine unit.

2. The mobile tie exchange machine arrangement of claim 1, wherein the machine units are mirror-symmetrically arranged on the track, the tie loading car of the first machine unit forming the beginning of the machine arrangement and the tie loading car of the second machine unit forming the end of the machine arrangement.

3. The mobile tie exchange machine arrangement of claim 1, further comprising a self-propelled ballast removal machine arranged on the track between the first and second machine units, the ballast removal machine comprising a machine frame supported by undercarriages on the track, an independent drive for propelling the machine frame along the track and vertically and transversely adjustable ballast scarifying means for removing ballast from respective cribs defined between adjacent ones of the ties.

4. The mobile tie exchange machine arrangement of claim 1, wherein each tie transport arrangement comprises a tie loading platform extending in a plane and auxiliary rails coplanar with the tie loading platform.

5. The mobile tie exchange machine arrangement of claim 4, wherein each tie transport arrangement comprises a first section mounted on the machine frame and essentially comprising a first tie conveyor band immediately adjacent the tie exchange device, a vertical tie conveyor adjacent the first tie conveyor band and a second tie conveyor band adjacent the vertical tie conveyor, and a second section mounted on the tie loading car and essentially comprising a gantry crane mounted for mobility on the auxiliary rails in the direction of the track, the gantry crane being equipped with vertically adjustably tie hoisting means.

6. The mobile tie exchange machine arrangement of claim 5, wherein the auxiliary rails are connected with the tie loading car and with a portion of the machine frame adjacent the second tie conveyor band and comprise longitudinally displaceable connecting rail sections bridging a gap between the tie loading car and the machine frame portion coupled thereto.

7. The mobile tie exchange machine arrangement of claim 5, wherein each machine frame is an elongated, bridge-like carrier frame defining an upwardly recessed center portion extending between respective ones of the undercarriages and carrying the vertical tie conveyor and the second tie conveyor band, and further comprising a carriage mounted in the upwardly recessed center portion below the carrier frame, the tie exchange device and the first tie conveyor band being mounted on the carriage.

8. The mobile tie exchange machine arrangement of claim 7, wherein the carriage is linked to the carrier frame at one end thereof adjacent the vertical tie conveyor and is supported on the track by an undercarriage at an end opposite the one carriage end.

9. The mobile tie exchange machine arrangement of claim 7, wherein the operator's cab of each machine unit is mounted on the carriage above the first tie conveyor band and the control is arranged in the operator's cab.

10. The mobile tie exchange machine arrangement of claim 1, further comprising a respective displacement drive linked to each tie exchange device for displacing the tie exchange device in the operating direction with respect to the machine frame.

* * * * *